US007732525B2

(12) United States Patent
Branston et al.

(10) Patent No.: US 7,732,525 B2
(45) Date of Patent: Jun. 8, 2010

(54) POLYMERS FOR PAPER AND PAPERBOARD COATINGS

(75) Inventors: Randy Branston, Greensboro, NC (US); William Peer, Patterson, NY (US); Tamal Ghosh, Ennetbaden (CH); Howard Roger Dungworth, Brighouse (GB)

(73) Assignee: Ciba Specialty Chemicals Water Treatments Limited, West Yorkshire (GB)

( * ) Notice: Subject to any disclaimer, the term of this patent is extended or adjusted under 35 U.S.C. 154(b) by 0 days.

(21) Appl. No.: 11/124,953

(22) Filed: May 9, 2005

(65) Prior Publication Data

US 2005/0261394 A1 Nov. 24, 2005

Related U.S. Application Data

(60) Provisional application No. 60/574,007, filed on May 20, 2004, provisional application No. 60/670,430, filed on Apr. 12, 2005.

(51) Int. Cl.
*C03C 17/00* (2006.01)
*B32B 27/10* (2006.01)

(52) U.S. Cl. ..... 524/501; 524/515; 428/507

(58) Field of Classification Search ..... 524/501, 524/515; 428/507
See application file for complete search history.

(56) References Cited

U.S. PATENT DOCUMENTS

| | | | | |
|---|---|---|---|---|
| 3,598,623 | A | 8/1971 | Powers et al. | 106/214 |
| 3,884,853 | A | 5/1975 | Zimmerman | 260/17.3 |
| 4,054,717 | A * | 10/1977 | Gill et al. | 428/452 |
| 4,384,069 | A | 5/1983 | Wendel et al. | 524/521 |
| 4,533,708 | A | 8/1985 | Costello | 526/295 |
| 5,032,226 | A * | 7/1991 | Winiker | 162/158 |
| 5,536,764 | A | 7/1996 | Nguyen et al. | 524/53 |
| 5,726,259 | A | 3/1998 | Hayes et al. | 526/80 |
| 5,851,651 | A | 12/1998 | Chao | 428/327 |
| 6,255,427 | B1 | 7/2001 | Exner et al. | 527/300 |
| 2003/0016280 | A1 | 1/2003 | Li et al. | 347/106 |
| 2003/0035932 | A1 | 2/2003 | Yamamoto et al. | 428/195 |
| 2003/0236326 | A1 | 12/2003 | Drenker et al. | 524/100 |

FOREIGN PATENT DOCUMENTS

| | | | |
|---|---|---|---|
| EP | 0 024 602 | | 3/1981 |
| GB | 1314539 | A * | 4/1973 |
| WO | WO 9109067 | A * | 6/1991 |
| WO | WO 0106999 | A1 * | 2/2001 |
| WO | 03/037641 | | 5/2003 |

OTHER PUBLICATIONS

Machine translation of WO 91/09067 A, Jun. 27, 1991.*
H. Hanciogullari, "Synthetic Co-binders and Thickeners", Pigment Coating and Surface Sizing of Paper, Chapter 15, pp. 219-239.
Y.-K. Lee et al., J. Ind. Eng. Chem., vol. 8, No. 5, (2002), pp. 443-453.
Y.-K. Lee et al., Kami Pa Gikyoshi, vol. 56, No. 4, (2002), pp. 543-548.

* cited by examiner

*Primary Examiner*—Vickey Nerangis
(74) *Attorney, Agent, or Firm*—Shiela A. Loggins

(57) ABSTRACT

The invention is directed to the composition and use of substantially water-soluble amphoteric (co)polymers as co-binders for paper and paperboard coating applications.

26 Claims, No Drawings

POLYMERS FOR PAPER AND PAPERBOARD COATINGS

This application claims the benefit of U.S. provisional application No. 60/574,007, filed on May 20, 2004 and U.S. provisional application No. 60/670,430, file on Apr. 12, 2005.

The invention is directed to the synthesis and use of substantially water-soluble amphoteric (co)polymers as a co-binder for paper and paperboard coating applications.

BACKGROUND OF THE INVENTION

Compositions for coating of paper and paperboard are well known in the art and usually comprise a pigment component, binder components and other miscellaneous coating components such as f lubricants, stabilizers, dispersants, defoamers, biocides, preservatives and mixtures thereof.

Paperboard coating co-binders compositions may additionally comprise protein, such as soy protein or casein, as a co-binder, to improve glueability and coating structure sufficiently for the coated board to be useful in the manufacture of boxes, cartons and other items. Protein also enhances the hiding power of the coating, improving the appearance of the coated board. However, protein suffers from numerous disadvantages. Protein is difficult to handle requiring a cooking or make-down step at high temperature, normally with concentrated ammonia right before addition to the paperboard coating. Protein solutions are especially susceptible to spoilage from biological attack. Since the color and properties of the paper coating composition will deteriorate as a result of the bacterial attack on the protein binder, it is often not possible to prepare large quantities of these materials for long paper coating runs. Accordingly, there is a desire in the art to replace protein with a co-binder component that does not have the protein cooking and make-down requirements and related spoilage and odor issues.

It would thus be advantageous to replace protein co-binder with a synthetic polymer which has the hiding power, glueability, coating bulking ability, blocking resistance and sheet gloss properties without the associated spoilage, odor and make-down problems associated with protein. The present inventors have surprisingly discovered that synthetic, substantially water-soluble amphoteric polymers function as well or better than proteins as co-binders in paper and paperboard coating applications. Since the amphoteric (co)polymers of the invention are available in solution (substantially water-soluble), their use as co-binder does not require complicated make-down procedures typical of protein co-binders.

Furthermore, the co-binder of the invention is also suitable for use in cast-coated paper. Cast coating involves pressing a coated substrate against a highly polished heated surface and drying the coated substrate against the polished surface. The term "casting," as used herein, is intended to mean the step in which a coated substrate is pressed and dried against the casting surface, regardless of the coated substrate's physical state. The three methods are wet casting, gel casting, and rewet casting. In each case, the surface of the cast-coated substrate exhibits the same gloss and smoothness as the highly polished casting surface.

Usually some combination of casein (a milk protein) with synthetic latex is used to achieve the correct coating composition suitable for cast-coated papers having an extremely high gloss, smoothness, and flexibility, pick resistance and drum release. However, the disadvantages of using casein are similar to those mentioned above for other proteins.

Thus the co-binder of the invention is also suitable as a casein replacement in cast coating.

Amphoteric (co)polymers are well known in the art. For example, U.S. Pat. No. 4,533,708 describes polyampholyte polymers. There is no suggestion to use these polymers as co-binders in paper and paperboard coatings.

Synthetic co-binders are known in the art. Specifically Hanciogullari, H., "Synthetic Cobinders and Thickeners," in PIGMENT COATING AND SURFACE SIZING OF PAPER, ed. E. Lehtinen, Fapet OY© 2000 (chapter 15, pp. 219-239) discusses the use of copolymers of nonionic monomers and acrylic acid or methacrylic acid as useful for adjusting rheological properties and water retention in paperboard coatings. Lee, Y et al., *Kami Pa Gikyoshi*, Vol. 56 (4), 2002, pp 543-548 discuss the effectiveness of amphoteric latexes in binder migration and uneven binder distribution in coating layers on acidic base paper. These amphoteric latexes are insoluble in water.

Lee, Y et al., *J. Ind. Eng. Chem*, Vol 8, (5), 2002, pp. 443-453 discuss the electrokinetic behavior of anionic and amphoteric latexes with pigment particles and base paper.

U.S. Pat. No. 5,536,764 discloses binder materials in which vinyl acetate grafted starch dispersions and blends of cationic starch and polyvinyl acetate are used to replace protein as co-binder in paperboard coating formulations.

All of the examples above deal with latex or latex blends (insoluble in water), which behave very differently than amphoteric substantially water-soluble (co)polymers of the invention particularly during coating consolidation and drying.

U.S. Pat. No. 6,255,427 discloses amphoteric polymeric dispersions obtained in the presence of at least one starch or starch derivative. The formed starch and amphoteric polymer may be used as a binder in pigment-containing coatings. U.S. Pat. No. 3,598,623 and U.S. Pat. No. 3,884,853 disclose amphoteric starches for use as binders in paper or paperboard. Both patents disclose derivatized starches containing carboxyl and tertiary amine groups. These starch-based amphoterics also suffer from similar spoilage and discoloration issues as protein hydrosylates.

U.S. Published application 2003/0016280 and 2003/0035932 disclose ink-receptive compositions. The compositions contain an amphoteric polymer, a water-soluble nonionic polymer and a polyalkylene glycol or silicone surfactant.

PCT Published application 2003/037641 discloses an inkjet media comprising a polymeric composition derived from at least one betaine monomer.

SUMMARY OF THE INVENTION

The present invention is directed to compositions and methods for coating paper and paperboard containing substantially water-soluble, amphoteric (co)polymers. Thus, the invention encompasses a paper and paperboard coating composition comprising (a) a substantially water-soluble amphoteric synthetic (co) polymeric co-binder, (b) a pigment, (c) a primary binder, and optionally, (d) other coating additives, wherein the (co)polymeric co-binder is formed from ethylenically unsaturated monomer(s) or macromer(s).

The amphoteric (co)polymer is formed from monomer(s) or macromer(s). The monomer(s) or macromer(s) can be uncharged or charged before polymerization but the final formed (co)polymer must be amphoteric, that is contain anionic and cationic charges.

It is also preferred that the paper and paperboard coating composition does not contain protein co-binder.

A charge for the purposes of the invention is electropositive or electronegative. For example, an anionic charge is electronegative and a cationic charge is electropositive.

For the purposes of the invention, substantially water-soluble means the amphoteric (co)polymer forms a clear to the eye solution in water. For example, the substantially water-soluble amphoteric (co)polymer may have a solubility of about equal to or greater than 5% by weight. The amphoteric (co) polymer may form a gel or microgel in water with or without slight turbibity. However, the amphoteric (co)polymer of the invention may have variable solubility in the actual paper or paperboard coating composition depending upon the pH, additional additives or other varying factors.

The term synthetic for the purposes of the invention means that the amphoteric (co)polymer co-binder of the invention is formed from ethylenically unsaturated monomer(s) or macromer(s), for example vinylic or allylic monomer(s) or macromer(s).

The polymerized monomer(s) or macromer(s) via the double bond form monomer(s) or macromer(s) units of the amphoteric (co)polymer co-binder.

Macromers also contain vinylic or allylic functionality, but their molecular weight is higher than most monomers. For example, poly(ethylene glycol)(meth)acrylate, poly(ethylene glycol) monomethyl ether mono(meth)acrylate are macromers.

The term "co-binder" in the invention refers to binders used in paper and paperboard coating formulation which cannot be used alone but need to be combined with another primary binder such as for example polyvinyl acetate, polyvinyl alcohol, starch, latex and mixtures thereof. The co-binder improves the strength of the dried coating as well as influences the rheology of the wet coating.

It is preferable that the amphoteric (co)polymer is not formed using naturally derived materials such as starch or protein but from monomer units derived from an ethylenically unsaturated monomer or macromers, for example vinylic or allylic monomers.

The substantially water-soluble amphoteric synthetic polymers of the invention are formed from at least one of the monomer(s) or macromer(s) selected from the groups consisting of (i) nonionic monomers or macromers, (ii) cationic or potentially cationic monomers or macromers, (iii) anionic or potentially anionic monomers or macromers, (iv) zwitterionic or potentially zwitterionic monomers or macromers, and optionally, (v) crosslinking agents, wherein the monomer(s) and/or macromer(s) are ethylenically unsaturated.

For example, the amphoteric (co)polymer may be formed from nonionic, cationic and anionic monomers or macromers. Alternatively, the amphoteric (co)polymer may be formed from nonionic and zwitterionic monomers or macromers or from cationic and anionic monomers or macromers only.

The amphoteric (co)polymer may also be formed from for example, acrylamide and then hydrolysed to form acid functionality and then treated with formaldehyde and secondary amines to form a Mannich base, thus creating an amphoteric polymer from a nonionic monomer.

The invention is also directed to a process for coating paper and paperboard wherein the paper or paperboard is coated with the composition comprising components (a), (b), (c) and optionally (d).

The invention is further directed to a paper or paperboard article coated with the composition (a), (b), (c) and optionally (d).

DETAILED DESCRIPTION OF THE INVENTION

Paperboard is used every day to create products such as disposable picnic supplies, covers for paperback books, folding cartons and beverage carriers. In the paper industry, the term paperboard refers to heavy papers like board stock. Board stock is a subgroup of paperboard used to make paper cups and plates, hot and cold food containers, ice cream containers, paper back book covers and the like. Boxboard, a second subgroup of paperboard, is used to make folding cartons such as cereal boxes, beverage carriers, and tissue boxes.

The end use of a product made from paperboard dictates the type of paperboard used. Paperboard characteristics such as cushion, strength, stiffness, wear resistance, coefficient of friction, density, caliper, color, brightness and smoothness are generally considered. In applications where enhanced printed graphics on the product is critical, characteristics such as smoothness and brightness are most important.

The paperboard utilized as above can specifically comprise one or more SBS ("solid bleached sulfate"), SUS ("solid unbleached sulfate") or recycled paperboard. The SUS and recycled furnish are brown or gray respectively with low brightness. Coatings for these surfaces require that the surface be made to look white. In order to obtain acceptable glueability, opacity, porosity and high coating structure, the synthetic substantially water-soluble amphoteric synthetic (co)polymeric co-binder of the instant invention replaces the protein co-binder in the paper and paperboard coating compositions.

In accordance with the methods herein, two, three or more coating units may be utilized to prepare the packaging material. In one aspect, the use of multiple coating methods may allow improved smoothness of the surface of the packaging material and may generally allow improved printability.

For example, when SUS paperboard is used, typically the paperboard is brown. Typically a leveling base coat is applied containing a white or colored pigment. A second opacifying topcoat is applied over the base coating to provide the required hiding power and uniform appearance. The amphoteric (co)polymeric co-binder of the invention is preferably added to the topcoat but can optionally be added to the basecoat or any other precoat applied to the paper or paperboard.

The co-binder of the present invention can also be used in coatings for light weight coated and free sheet papers. The co-binder will enhance coating bulk, thus allowing for better fiber coverage. The coating is applied to the paper or paperboard to cover the fibrous paper surface and to produce a smoother and less absorbent surface on which to apply printing inks and other functional coatings. The co-binder is particularly good for rheology control and dewatering. The co-binder is especially useful in cast coatings.

It will be recognized that when the composition containing (a) thru (d) is applied, one or more layers are applied wet and should normally be dried by the usual techniques employed by board manufacturers.

The substantially water-soluble amphoteric synthetic (co) polymers of the invention are formed from at least one of the different monomer(s) or macromer(s) selected from the groups consisting of i) nonionic monomers or macromers, ii) cationic or potentially cationic monomers or macromers, iii) anionic or potentially anionic monomers or macromers, and, iv) zwitterionic or potentially zwitterionic monomers or macromers, and optionally, v) crosslinking agents, wherein the monomer(s) or macromer(s) are ethylenically unsaturated.

More than one monomer or macromer may be selected from each group. Alternatively, one monomer or macromer from several or all groups can be selected to form the final amphoteric polymer.

The nonionic monomer(s) or macromer(s) of (i) are polymerizable allylic, vinylic compounds and are electrically neutral. Representative nonionic monomers include acrylamide, methacrylamide, N-methyl(meth)acrylamide, N,N-methyl (meth)acrylamide, N-isopropyl(meth)acrylamide, N-(2-hydroxypropyl)(meth)acrylamide, poly(ethylene glycol)(meth) acrylate, poly(ethylene glycol) monomethyl ether mono (meth)acrylate, N-methylolacrylamide, N-vinylformamide, N-vinylacetamide, N-vinyl-N-methylacetamide, fumaramide, N-vinyl-2-pyrrolidone, glycerol mono((meth)acrylate), 2-hydroxyethyl(meth)acrylate, vinyl methylsulfone, vinyl acetate, diacetone acrylamide, diesters of maleic, fumaric, succinic and itaconic acids, Hydrophobic, nonionic monomers include acrylates such as methyl(meth)acrylate, ethyl(meth)acrylate, hexyl(meth)acrylate, hexyl(meth)acrylate, octyl(meth)acrylate, stearyl(meth)acrylate, stearyl ethoxy(meth)acrylate stearyl ethoxyallylether and mixtures thereof.

Suitable preferred nonionic monomer, monomers or macromers (i) are for instance acrylamide, methacrylamide, methyl methacrylate, methyl acrylate, hydroxyethyl methacrylate (HEMA), vinyl acetate, poly(ethylene glycol)(meth) acrylate, poly(ethylene glycol) monomethyl ether mono (meth)acrylate and mixtures thereof.

The most preferred nonionic monomer of the invention is acrylamide.

The cationic or potentially cationic monomer(s) or macromer(s) of (ii) are derived from nitrogen containing ethylenically unsaturated monomers.

Suitable cationically charged or potentially cationically charged monomers or macromers are selected from the group consisting of dialkylaminoalkyl(meth)acrylates, quaternized dialkylaminoalkyl(meth)acrylates, dialkylaminoalkyl(meth) acrylate acid salts, allyl or diallyl amines and their quaternary or acid salts, and Mannich products and salts thereof.

Representative examples can be selected from the group consisting of suitable cationically charged or potentially cationically charged monomers including dimethylaminoethyl acrylate methyl chloride quaternary salt, dimethylaminoethyl acrylate methyl sulfate quaternary salt, dimethylaminoethyl acrylate benzyl chloride quaternary salt, dimethylaminoethyl acrylate sulfuric acid salt, dimethylaminoethyl acrylate hydrochloric acid salt, dimethylaminoethyl methacrylate methyl chloride quaternary salt, dimethylaminoethyl methacrylate methyl sulfate quaternary salt, dimethylaminoethyl methacrylate benzyl chloride quaternary salt, dimethylaminoethyl methacrylate sulfuric acid salt, dimethylaminoethyl methacrylate hydrochloric acid salt, diethylaminoethyl acrylate, diethylaminoethyl acrylate methyl chloride quaternary salt, diethylaminoethyl methacrylate, diethylaminoethyl methacrylate methyl chloride quaternary salt, methacrylamidopropyltrimethylammonium chloride, acrylamidopropyltrimethylammonium chloride, dimethylaminopropylacrylamide methyl sulfate quaternary salt, dimethylaminopropylacrylamide sulfuric acid salt, dimethylaminopropylacrylamide hydrochloric acid salt, diallyldiethylammonium chloride, diallyldimethyl ammonium chloride, diallylamine, and vinylpyridine.

Most preferred monomers of (ii) are N,N-dimethylaminoethylmethacrylate and its methyl chloride quaternary salt, and diallyldimethylammonium chloride The anionic or potentially anionic monomer, monomers or macromers of (iii) are derived from alpha ethylenically unsaturated monomers selected from the groups consisting of alpha ethylenically unsaturated monomers containing phosphate or phosphonate groups, alpha ethylenically unsaturated monocarboxylic acids, monoalkylesters of alpha ethylenically unsaturated dicarboxylic acids, monoalkylamides of alpha ethylenically unsaturated dicarboxylic acids, alpha ethylenically unsaturated compounds comprising a sulphonic acid group, salts of alpha ethylenically unsaturated compounds comprising a sulphonic acid group and mixtures thereof.

Representative examples of anionic or potentially anionic monomers include acrylic acid, methacrylic acid, vinyl sulphonic acid, salts of vinyl sulfonic acid, vinylbenzene sulphonic acid, salts of vinylbenzene sulphonic acid, alpha-acrylamidomethylpropanesulphonic acid, salts of alpha-acrylamidomethylpropanesulphonic acid, 2-sulphoethyl methacrylate, salts of 2-sulphoethyl methacrylate, acrylamido-2-methylpropanesulphonic acid (AMPS), salts of acrylamido-2-methylpropanesulphonic acid, maleic acid, fumaric acid, itaconic acid, succinic acid, styrenesulphonate and its salts or mixtures thereof.

The most preferred monomer or monomers of (iii) are (meth)acrylic acid, 2-acrylamide-2-methylpropanesulphonic acid or salts thereof, acrylic acid or methacrylic acid or salts thereof being the most preferred.

The zwitterionic monomer or monomers of (iv) are derived from ethylenically unsaturated monomer or monomers. A zwitterionic monomer for the purposes of the invention is defined as a monomer that contains both anionic and cationic charges.

Representative examples are

N,N-dimethyl-N-acryloyloxyethyl-N-(3-sulfopropyl)-ammonium betaine,

N,N-dimethyl-N-acryloyloxyethyl-N-(2-carboxymethyl)-ammonium betaine,

N,N-dimethyl-N-acrylamidopropyl-N-(3-sulfopropyl)-ammonium betaine,

N,N-dimethyl-N-acrylamidopropyl-N-(2-carboxymethyl)-ammonium betaine, 2-(methylthio)ethyl methacryloyl-S-(sulfopropyl)-sulfonium betaine, 2-[(2-acryloylethyl)dimethylammonio]ethyl 2-methyl phosphate, 2-(acryloyloxyethyl)-2'(trimethylammonium)ethyl phosphate,

[(2-acryloxyethyl)dimethylammonio]methyl phosphonic acid, 2-methacryloyloxyethyl phosphorylcholine (MPC), 2-[(3-acrylamidopropyl)dimethylammonio]ethyl 2'-isopropyl phosphate (AAPI), 1-vinyl-3-(3-sulfopropyl)imidazolium hydroxide, (2-acryloxyethyl) carboxymethyl methylsulfonium chloride, 1-(3-sulfopropyl)-2-vinylpyridinium betaine, N-(4-sulfobutyl)-N-methyl-N,N-diallylamine ammonium betaine (MDABS), N,N-diallyl-N-methyl-N-(2-sulfoethyl)ammonium betaine or mixtures thereof.

The most preferred zwitterionic monomers of iv) are

N,N-dimethyl-N-acryloyloxyethyl-N-(3-sulfopropyl)-ammonium betaine or

N,N-dimethyl-N-acrylamidopropyl-N-(3-sulfopropyl)-ammonium betaine.

The molecular weight of the amphoteric polymer is about 40,000 to 2,000,000 daltons, preferably about 40,000 to 500,000 daltons, and most preferably 80,000 to 250,000 daltons as measured by GPC with polyoxyethylene as the standard.

The substantially water-soluble amphoteric synthetic (co) polymer comprises from about 20 to about 99 weight percent monomer units derived from at least one monomer or macromer selected from the group (i), about 0.0 to about 40 weight percent monomer or macromer units derived from at least one monomer selected from the group (ii.), from about 0.0 to about 40 weight percent monomer or macromer units derived from at least one monomer selected from the group (iii) and from about 0.0 to about 40 weight percent monomer or macromer units derived from at least one monomer or macromer selected from the group (iv).

The substantially water-soluble amphoteric (co)polymer makes up about 0.1 to 15 parts per hundred parts of pigment (php). Preferably the substantially water-soluble amphoteric (co)polymer makes up about 0.5 to 6 parts per hundred of pigment. For example about 2 to about 5 parts co-binder may be used per hundred of pigment in a cast coating.

The weight percent monomer units are based on the total weight of the (co)polymer. That is, the weight percent does not include other ingredients.

The amphoteric polymer may have a molar charge ratio of anionic charge to cationic charge of about 0.5 to about 10, preferably from about 1 to about 5, and most preferably from about 1.1 to about 4.

The anionic to cationic molar charge ratio of the amphoteric (co)polymer is defined as the moles of anionic monomer(s) divided by the moles of cationic monomer(s) used to form the amphoteric (co)polymer.

The pH of the solution will influence the net charges on the formed amphoteric (co)polymer. For example, the anionic charge will decrease as the pH of the solution decreases. However, for the purposes of the invention, the molar charge ratio of anionic charge to cationic charge is defined as above.

It is not necessary that the anionic charges equal the cationic charges or give an overall electrically neutral amphoteric polymer. The net charge may be either cationic or anionic.

For example, the net charge is anionic, that is the amphoteric polymer will be formed from an excess of negatively charged monomers.

Polymerization of the monomers or macromers can optionally occur in the presence of a polyfunctional cross-linking agent to form a cross-linked composition or the crosslinking agent can be added after polymerization of the base polymer. The crosslinking agent comprises molecules having at least difunctionality for example two double bonds, a double bond and a reactive group, or two reactive groups or mixtures thereof.

Furthermore, reactive crosslinkers for anchoring the amphoteric polymer to the paper may be part of the amphoteric (co)polymer.

Crosslinking agents, for example, can comprise at least one difunctional monomer chosen from N,N'-methylenebisacrylamide, trimethylolpropane tri(meth)acrylate, glycerol tri(meth)acrylatemethylol acrylamide, N,N'-methylenebis-methacrylamide, polyethyleneglycol diacrylate, polyethyleneglycol dimethacrylate, N-vinylacrylamide, glycidyl acrylate, divinylbenzene, acrolein, glyoxal, diepoxy compounds, epichlorohydrin, tetraallylammonium chloride and mixtures of any of the foregoing.

Reactive, nonionic crosslinkers for anchoring the amphoteric (co)polymer to the paper may be part of the amphoteric copolymer. For example, reactive crosslinkers include glycidyl(meth)acrylate and allyl glycidyl ether.

The optional crosslinking agents or reactive crosslinkers are used at about 0% to about 3% by weight based on the total weight of the amphoteric (co)polymer. The optional crosslinking agents or reactive crosslinkers may be used at about 0 to about 0.5% by weight based on the total weight of the amphoteric polymer.

A suitable initiator system for synthesizing the final amphoteric polymer can be a thermal initiator, for instance aqueous ammonium persulfate or other persulfate salts, 2,2'-azobis(2-methylpropionamide)dihydrochloride or other azo compounds, or a redox initiator couple such as sodium metabisulphite/tertiary butyl hydroperoxide, optionally with other initiators.

The appropriate amount of initiator to effect the polymerization is well know in the art.

The pigment of component (b) comprises at least one pigment. Preferably the pigment is white or near white but can also be colored. For examples, the near white or white pigments are preferably selected from the group consisting of kaolin, calcium carbonate, precipitated calcium carbonate, calcined kaolin, titanium dioxide, aluminum trihydrate, talc, calcium sulfate (gypsum), precipitated silica, calcined clay, zeolites or mixtures thereof. The pigment of component (b) may also include organic pigments such as synthetic polymeric pigments and mixtures thereof.

The pigment component (b) can also include extenders used to cut the higher cost white pigment. For example in applications where titanium dioxide is the higher cost white pigment, the extender is calcined clay, The pigment component (b) makes up about 20 to about 90 percent of the total weight solids of the coating formulation, preferably about 50 to about 90 percent by weight.

Primary binders are used with the co-binder of the instant invention.

In particular, suitable synthetic primary binders may comprise latex polymers such as styrene butadiene, polyvinyl acetate, polyvinyl acetate-acrylate, ethylene vinyl acetate, styrene acrylate lattices and solution polymers such as starch, modified starch, polyvinyl alcohol and mixtures thereof.

One of ordinary skill in the art will recognize that such binders may be useful in the methods of the present invention to assist in holding the pigment particles together and to the paper or paperboard substrate. The type of binder utilized in the methods of the present invention may vary depending on the paper or paperboard substrate and the intended end use for the paper or paperboard material. For example, SBR binders typically provide very good binding strength, gloss, ink holdout, and flexibility.

Polyvinylacetate binders can provide good gluing properties, brightness stability, ink receptivity, and low odor.

Binder amounts to be included in the solution, vary from about 5 to about 60%, more preferably from about 5 to about 40%, and most preferably from about 10 to about 40% by weight of total solid pigments in the formulation.

Coating processes that may be utilized include, but are not limited to: cast coating, jet coating, roll coating, rigid blade, straight blade or bent blade, air knife, rod coating or a combination of coaters.

Compositions for coating of paperboard are well known in the art and comprise in addition to the pigment component and binder components miscellaneous other components such as lubricants, stabilizers, dispersants, defoamers, biocides, and preservatives.

Other components can also be added to the paper or paperboard compositions to help bind the formulated coating to the paper such as for example, glyoxal or zirconium compounds such as ammonium zirconium carbonate.

The examples below illustrate the invention in more detail. They are not to be construed as limiting the instant invention in any manner whatsoever. The invention is declared to cover all changes and modifications of the specific examples that do not constitute a departure from the spirit and scope of the invention.

Parts and percentages are, as in the remainder of the description and in the claims, by weight, unless stated otherwise. All of the base coat and topcoat formulations are based on the dry weight of the total pigment or parts per hundred of the pigment (php). For example, in the topcoat coating formulations in Table 3B, the kaolin and $TiO_2$ pigments represent 100 parts. The amphoteric (co)polymer makes up 0.5 parts to 6.0 parts by hundred of the dry pigment. The monomer or macromer compositions of the amphoteric (co)polymers of the invention are listed in weight % of the total polymer formed in Table I. The crosslinker is listed in parts per million (ppm) and the molecular weights are listed in kilo Daltons (kDa).

Examples Lab and Pilot Scale

Synthesis of Amphoteric Copolymers

A 1 litre flask containing 381.6 g of water is fitted with stirrer, condenser, nitrogen inlet, thermometer and monomer and initiator feed lines. The contents of the flask are degassed with nitrogen for 30 minutes and heated to 85° C. before adding 1.73 g ammonium persulphate dissolved in 5 g water. Monomer and initiator feeds of the following composition are added to the flask over 2 hours,

| | |
|---|---|
| 51.8% aqueous solution of Acrylamide | 416.0 g |
| Glacial Acrylic Acid | 25.7 g |
| 63.9% aqueous solution of Diallyldimethyl ammonium chloride | 45.2 g |
| Ammonium persulfate | 2.3 g |
| Water | 22.5 g |

The vessel contents is held between about 85-90° C. throughout the addition period and for a further 1 hour after the completion of the feeds to allow complete polymerization. The polymer solution is then cooled and neutralized with ammonia to pH 8.6. The resulting polymer solution has a dry weight of 30.3% and a Brookfield RVT viscosity (spindle 4, 20 rpm) of 550 cP (centipoises). Table 1 gives a summary of the various amphoteric (co)polymers prepared by the method above.

All the other examples are prepared in the same manner as above but the monomers and ratios of monomers are varied. In examples 2, 3 and 6 crosslinker and/or reactive crosslinker are added.

In some of the examples, 2,2'-azobis(2-methylpropionamide)dihydrochloride is used as the initiator rather than ammonium persulfate.

TABLE 1

Weight Percent Composition of Lab Scale Amphoteric Polymers

| | Example | | | | | | | | | | |
|---|---|---|---|---|---|---|---|---|---|---|---|
| | 1 | 2 | 3 | 4 | 5 | 6 | 7 | 8 | 9 | 10 | 11 |
| Aam | 79.8 | 62.8 | 53.2 | 70.3 | 48.2 | 70.7 | 66.2 | 80 | 80.1 | 78.1 | 95 |
| AA | 9.5 | 17.2 | 17.6 | 19 | 16.4 | 9.4 | | 9.5 | 9.6 | 9.3 | |
| PEGMA | | 9.4 | | | 8.9 | | | | | | |
| DADMAC | 10.7 | 9.6 | 19.5 | 10.7 | 18.3 | 10.5 | | | | | |
| MAC | | | | | 8.2 | 9.4 | | | | | |
| NaAMPS | | | | | | | 25.1 | | | | |
| DMAEMA | | | | | | | 8.6 | 10.4 | | | |
| DMAPA | | | | | | | | | 10.4 | | |
| DMAEMAq MeCl | | | | | | | | | | 12.6 | |
| SPDMAEMA | | | | | | | | | | | 5 |
| MBA (ppm) | | | 25 | | | 25 | | | | | |
| GMA | | 1 | 1 | | | | | | | | |
| $M_w$ (kDa) | 170 | 324 | 277 | 483 | 299 | 151 | 177 | 116 | 87 | 103 | 131 |

Abbreviations

| | |
|---|---|
| AAM | Acrylamide |
| AA | Acrylic Acid |
| DADMAC | 2-propen-1-aminium, N,N-dimethyl-N-2-propenyl-, chloride |
| MBA | Methylene-bis-acrylamide |
| GMA | Glycidyl methacrylate |
| MAC | Methylacrylate |
| PEGMA | Poly(oxy-1,2-ethanediyl), α-(2-methyl-1-oxo-2-propenyl)-ω-methoxy- |
| DMAEMA | Dimethylaminoethyl methacrylate |
| DMAEMAqMeCl | Dimethylaminoethyl methacrylate, methyl chloride quat |
| DMAPA | Dimethylaminopropyl acrylamide |
| NaAMPS | 2-Acrylamido-2-methylpropane sulfonate, sodium salt |
| SPDMAEMA | N,N-dimethyl-N-methacryloyloxyethyl-N-(3-sulfopropyl)- |

TABLE 1-continued

| | |
|---|---|
| | ammonium betaine |
| $M_w$ | Weight average molecular weight, PEO standards |
| kDa | Kilo Daltons |

Make-Down of Protein

The amphoteric (co)polymers of the invention are supplied as aqueous solutions and require no further make-down procedure. The protein co-binder requires a make-down procedure that calls for heating enough water to a temperature of 60-70° C. to allow for a final protein concentration of 16-18%. This is followed by adding concentrated $NH_4OH$ to raise and hold the mixture at pH ~9 and cooking at 60-70° C. for 20-30 minutes.

Lab Scale Applications Testing

The Paperboard used in the application testing is recycled board (caliper=22 points, basis weight=450 $gm^2$). The paperboard samples are first coated with a basecoat then followed with a topcoat. The amphoteric co-binders of the invention are formulated within the topcoat.

Typical air knife board coating formulations are presented in Table 3A and 3B. Table 3A presents the basecoat formulations at 12 $g/m^2$ and 3B presents the topcoat formulations at 15 $g/m^2$. The coating pH is adjusted to 9.0 using NaOH. The basecoat and the topcoat were applied with a rod coater. All weights are parts per hundred of dry pigment (php).

TABLE 3A

Basecoat Coating Formulation

| Ingredient | Weight in parts per hundred pigment (php) |
|---|---|
| #2 kaolin | 100 |
| Poly vinyl acetate | 18 |
| Sodium polyacrylate | 0.2 |
| PH (with 10% caustic) | 9.0 |
| Wt % solids | 62.0 |
| Coat weight | 15 $g/m^2$ |

TABLE 3B

Topcoat Coating for Amphoteric Co-binder Formulations

| Ingredient | Weight in parts per hundred pigment (php) |
|---|---|
| #1 kaolin | 80 |
| $TiO_2$ | 20 |
| Poly vinyl acetate | 15 |
| Lubricant | 1 |
| Glyoxal Crosslinker# | 0.1 |
| Dispersant | 0.2 |
| Amphoteric co-binder (co)polymer | 3.5 |
| PH (with 10% caustic) | 9.0 |
| Wt % solids | 40.0-46.0% |
| Coat weight | 15 $g/m^2$ |

#Ammonium zirconium carbonate is used in a number of the examples as a replacement for glyoxal crosslinker.

All of the amphoteric polymers in examples are formulated in a topcoat as in Table 3B except for example 7. The topcoat formulation for example 7 differs in that there is 0.3 parts ammonium zirconium carbonate crosslinker instead of glyoxal, the co-binder is present at 6 php and the total solids are 50%.

For comparison purposes, a topcoat formulation using soy protein is shown in Table 3C. Application results in Table 3D for examples 1-8 and 10 are compared to the soy formulation.

TABLE 3C

Topcoat Coating for Soy Protein Co-binder Formulation

| Ingredient | Weight in parts per hundred pigment (php) |
|---|---|
| #1 kaolin | 80 |
| $TiO_2$ | 20 |
| Poly vinyl acetate | 15 |
| Lubricant | 1 |
| Glyoxal Crosslinker | 0.1 |
| Dispersant | 0.2 |
| Soy protein* | 4.5 |
| PH (with 10% caustic) | 9.0 |
| Wt % solids | 45-46% |
| Coat weight | 15 $g/m^2$ |

*Protein produced from soybeans. It is amphoteric in solution and the molecular weight is approximately 150,000 Daltons.

TABLE 3D

Lab - Scale Application Results
All coatings are calendered to the same smoothness.

| | Example | | | | | | | | | | | |
|---|---|---|---|---|---|---|---|---|---|---|---|---|
| | 1 | 2 | 3 | 4 | 5 | 6 | 7 | 8 | 10 | Soy1 | Soy2 | Soy3 |
| Glueability[1] P = Pass F = Fail | P | P | P | P | P | P | P | P | P | P | P | P |
| Adams Wet Rub NTU[2] | 155.5 | 91.2 | 84.8 | 106.8 | 61.2 | 65.6 | 176 | 92 | 108 | 41 | 55 | 53 |

TABLE 3D-continued

Lab - Scale Application Results
All coatings are calendered to the same smoothness.

| | Example | | | | | | | | | | | |
|---|---|---|---|---|---|---|---|---|---|---|---|---|
| | 1 | 2 | 3 | 4 | 5 | 6 | 7 | 8 | 10 | Soy1 | Soy2 | Soy3 |
| TAPPI Brightness[3] % | 73.4 | 73.8 | 72.6 | 73.6 | 75.5 | 72.2 | 80.1 | 73.6 | 73.0 | 72.2 | 73.2 | 73.1 |
| TAPPI Sheet Gloss[4] MD | 51.2 | 50.7 | 50.6 | 48.9 | 49.3 | 50.9 | 57.5 | 50.8 | 50.0 | 47.8 | 47.0 | 47.4 |
| Print Gloss[5] % MD | 75.1 | 74.4 | 74.7 | 72.6 | 74.5 | 72.7 | 79.6 | 72.1 | 70.7 | 70.3 | 73.4 | 74.4 |
| K&N Ink[6] | 20.7 | 21.5 | 21.6 | 21.8 | 20.6 | 20.7 | 28.2 | 21.0 | 23.5 | 20.3 | 17.6 | 20.6 |
| IGT Dry Pick VVP[7] | 29.5 | 28.2 | 30.3 | 36.1 | 28.9 | 29.5 | 29.6 | 35.4 | 28.8 | 30.3 | 27.5 | 31.0 |

[1]Glueability Test

The coated paperboard is cut into 1" by 2" sheets in the machine direction. One side of the paper is treated with a basecoat and topcoat. Other side of paper is treated with a clay coating. Onto the dried topcoat treated side, adhesive is applied at 350° C. in the direction of the paper. The clay coated side is mated to the coated side and the bond is given 10 seconds compression with a 150 g weight. After 24 hours at room temperature, the bonds are pulled by hand and evaluated for percent fiber tear. Failure on the coated side of the board is recorded. Satisfactory ratings is > 60% fiber tear.

[2]Adams Wet Rub

The coating is wetted and rubbed mildly for 20 seconds. The amount of 'milking' is measured by the amount of coating removed (in milligrams) or by the opacity of the water solution. The Adams Wet Rub test is measured in nephelometric turbidity units or NTU.

[3]TAPPI Coated Board Brightness

Method TAPPI -452 om-98 is used to determine brightness.

[4]TAPPI Sheet Gloss

Method TAPPI Sheet Gloss 480 om-99 is used to determine specular gloss of the paperboard. MD refers to Machine Direction.

[5]Print Gloss

Print gloss was determined by placing a 4.8 um ink film on the coated paper and measuring gloss on a 75 Gardner Glossmeter II.

[6]K&N values

The K&N ink test measures the brightness values before and after the application of the K&N ink. Testing is performed by applying K&N ink to a paper sample for two minutes and then removing the excess ink. The brightness is measured and compared to the initial brightness: % Drop = (initial brightness − final brightness) × 100/Initial Brightness

[7]IGT Dry Pick Strength

The IGT pick strength (reported as a product of velocity and viscosity--VVP) is determined by using different viscosity oils and applying them at different speeds until the coating fails (picks). Pick strength is measured on an AIC2-5 Model IGT pick tester sold by Techno Graphic Instruments. The teat was run with a setting of 2 m/s using LV oil and a pressure setting of 50 kg. LV oil is polybutene with a viscosity of 242 poise at 23° C. Pick Values in VVP (velocity-viscosity product as defined by IGT) are reported.

Additional amphoteric (co)polymers are prepared with varying weight percent of monomers listed in Table 3E. These amphoteric (co)polymers of examples 12 to 15 are then formulated as in Table 3F and applied in a Pilot Coater Trial described below.

Basestock was 18 pt recycled paperboard, precoated with a clay/latex formulation at a coat weight of 3-3.4 #/1,000 $ft^2$. Formulations in Table 3F are applied with an air-knife coater at coat weights ranging from 3.5-3.8 #/1,000 $ft^2$. The coated board is hot-soft calendered 2 nips, at a temperature of 170° F., and a pressure of 575 PLI.

Table 3G(i.) and 3G(ii.) gives a summary of the application results of the Pilot Coater Trial.

TABLE 3E

Weight Percent Composition of Amphoteric (Co)Polymers in Pilot Coater Trial.

| | Ex. | | | |
|---|---|---|---|---|
| | 12 | 13 | 14 | 15 |
| Aam | 61.9 | 79.8 | 75.1 | 84.7 |
| AA | 17.9 | 9.5 | 14.3 | 9.8 |
| PEGMA | | | | |
| DADMAC | 20.1 | 10.7 | 10.7 | 5.5 |
| MAC | | | | |
| Mw, (kDa) | 218 | 261 | 245 | 303 |

TABLE 3F

Pilot Coater Trial Plan:

| Formulations: | Coating Number Air knife Topcoat | | | | | | |
|---|---|---|---|---|---|---|---|
| Materials | 1 | 2 | 3 | 4 | 5 | 6 | 7 |
| Clay | 77 | 77 | 77 | 77 | 77 | 77 | 77 |
| TiO2 | 23 | 23 | 23 | 23 | 23 | 23 | 23 |
| Dispersant | 0.2 | 0.2 | 0.2 | 0.2 | 0.2 | 0.2 | 0.2 |
| Latex | 16 | 16 | 16 | 16 | 16 | 16 | 16 |
| Protein | 5 | 0 | 0 | 0 | 0 | 0 | 0 |
| Polymer 14 | 0 | 2.5 | 0 | 1.5 | 0 | 0 | 0 |
| Polymer 15 | 0 | 0 | 2.5 | 0 | 1.5 | 0 | 0 |
| Polymer 12 | 0 | 0 | 0 | 0 | 0 | 0.5 | 0 |
| Polymer 13 | 0 | 0 | 0 | 0 | 0 | 0 | 0.5 |
| Insolubilizer | 0.3 | 0.3 | 0.3 | 0.3 | 0.3 | 0.3 | 0.3 |
| Lubricant | 0.2 | 0.2 | 0.2 | 0.2 | 0.2 | 0.2 | 0.2 |
| pH | 9 | 9 | 9 | 9 | 9 | 9 | 9 |
| Solids | 50 | 50 | 50 | 50 | 50 | 50 | 50 |
| Viscosity (20/rpm) cps | 400-300 | 400-300 | 400-300 | 400-300 | 400-300 | 400-300 | 400-300 |
| Ct. wt. #/1000 $ft^2$ | 3.0 | 3.0 | 3.0 | 3.0 | 3.0 | 3.0 | 3.0 |
| Ctr speed, ft/min | 700 | 700 | 700 | 700 | 700 | 700 | 700 |

TABLE 3G (i.) Application Testing Pilot Coater Trial

| Sample ID, | Adams Wet Rub NTU | Brightness % | | K&N Ink Test Brightness, % drop | | PPS Roughness mm | |
|---|---|---|---|---|---|---|---|
| Amount (php) | Cal. Ave. | Uncal.* Ave. | Cal.* Ave. | Uncal. Ave. | Cal. Ave. | Uncal. Ave. | Cal. Ave. |
| Protein, 5 php | 17 | 78.1 | 77.8 | 18.3 | 15.0 | 3.27 | 2.41 |
| 14, 1.5 php | 19 | 78.5 | 77.9 | 15.4 | 13.2 | 2.97 | 2.44 |
| 15, 1.5 php | 24 | 78.7 | 78.3 | 15.0 | 13.2 | 3.10 | 2.54 |
| 12, 0.5 php | 19 | 79.2 | 78.5 | 21.9 | 18.1 | 3.02 | 2.40 |
| 13, 0.5 php | 9 | 80.1 | 79.1 | 23.2 | 18.6 | 3.06 | 2.44 |

*Uncalendered = Uncal.
*Calendered = Cal.

TABLE 3G (ii.) Application Testing Pilot Coater Trial Cont.

| | | Print Gloss % | | Sheet Gloss, % | | | |
|---|---|---|---|---|---|---|---|
| | Print Density | Calendered (Cal.) | | Uncalendered (Uncal.) | | Calendered (Cal.) | |
| Sample ID | Cal. Ave. | MD | CMD | MD | CMD | MD | CMD |
| Protein, 5 php | 1.22 | 71.7 | 67.1 | 31.8 | 29.1 | 40.2 | 39.0 |
| 14, 1.5 php | 1.26 | 73.8 | 68.0 | 33.0 | 31.7 | 39.8 | 38.2 |
| 15, 1.5 php | 1.27 | 75.1 | 67.0 | 33.2 | 32.5 | 41.0 | 38.7 |
| 12, 0.5 php | 1.22 | 70.5 | 65.8 | 31.8 | 31.2 | 38.0 | 37.3 |
| 13, 0.5 php | 1.20 | 68.7 | 63.6 | 31.5 | 30.9 | 38.6 | 37.1 |

TABLE 3h (i.) Application Testing Pilot Coater Trial cont'd

| | Blocking Resistance[8] | | DAV[9] | | Aqueous Glueability Pull Tab | Aqueous Glueability AGT | Hot Melt Glueability | |
|---|---|---|---|---|---|---|---|---|
| Sample ID | 60C | 120C | Uncal. Ave. | Cal. Ave. | Ave.[10] (sec.) | Ave.[11] (%) | PA Type % Fiber Tear | PE Type % Fiber Tear |
| Protein, 5 php | 0 | 0 | 72.0 | 89.0 | 60.0 | 29.1 | 100 | 100 |
| 14, 1.5 php | 0 | 0 | 71.0 | 78.0 | 60.0 | 31.7 | 100 | 100 |
| 15, 1.5 php | 0 | 0 | 68.0 | 74.0 | 60.0 | 32.5 | 100 | 100 |

TABLE 3h-continued (i.) Application Testing Pilot Coater Trial cont'd

| | Blocking Resistance[8] | | DAV[9] | | Aqueous Glueability Pull Tab | Aqueous Glueability AGT | Hot Melt Glueability | |
|---|---|---|---|---|---|---|---|---|
| Sample ID | 60C | 120C | Uncal. Ave. | Cal. Ave. | Ave.[10] (sec.) | Ave.[11] (%) | PA Type % Fiber Tear | PE Type % Fiber Tear |
| 12, 0.5 php | 0 | 0 | 73.0 | 76.0 | 60.0 | 31.2 | 98 | 100 |
| 13, 0.5 php | 0 | 0 | 61.0 | 68.0 | 60.0 | 30.9 | 98 | 100 |

[8]Blocking Resistance.
Pilot Coater Samples were measured for Blocking Resistance as per ASTM Method D918-99.
[9]DAV or Dupont Appearance Viewer.
Instrumentation assesses uniformity and whiteness of coated board. The lower the number the more uniform the coverage of the board by the coating, and the whiter in appearance. In this response range above a difference of 10 units can be detected by the casual observer.
[10]Aqueous Glueability, Pull Tab method.
The Glue Speed test measures the length of time, after gluing, that is required to obtain fiber tear. A #30 Meyer rod is used to apply glue to a specimen 12 inches long. Another specimen is placed on top of the glued one and put a 12-lb weight on top of both. The specimens are pulled apart at regular time intervals, (15 sec.) until 75% fiber tear is observed. The result is the time required to obtain to 75% fiber tear. Samples having glue time less than 90 sec in this test are deemed acceptable.
[11]Aqueous Glueability, AGT method.
A dot of glue of precise thickness is applied to the board. The tested compresses the specimens at a given pressure for a given amount of time and then separates the samples. The amount of fiber tear is assessed. The AGT also measures the force required to separate glued specimens. The standard test compression time is 4 minutes at 20 psi. Samples showing at least 75% fiber tear are deemed acceptable by this test.

TABLE 3h (ii.) Application Testing Pilot Coater Trial cont'd

| | P&I Testing[12] | | | Water Sensitivity | | |
|---|---|---|---|---|---|---|
| Sample ID | Passes To Fail Cal. Ave. | Force to Fail Cal. Ave. | Slope Cal. Ave. | Ink Transfer Cal. Ave. | Ink Refusal Cal. Ave. | Wet Pick % Cal. Ave. |
| Protein, 5 php | 10.0 | 530.0 | 4.4 | 60.0 | 34.0 | 6.0 |
| 14, 1.5 php | 10.0 | 718.0 | 7.3 | 62.0 | 31.0 | 7.0 |
| 15, 1.5 php | 10.0 | 699.0 | 7.0 | 62.0 | 33.0 | 5.0 |
| 12, 0.5 php | 9.0 | 700.0 | 8.4 | 58.0 | 21.0 | 21.0 |
| 13, 0.5 php | 7.0 | 624.0 | 9.5 | 71.0 | 17.0 | 12.0 |

[12]P&I Testing.
Samples are placed on a modified Vandercook press and then printed with an inked roller, containing a defined amount of ink numerous times until picking is observed. If no picking is observed, the test is stopped at 10 passes. A value of 4 is the minimum acceptable result in this test. The force to fail is measured by a transducer on the ink roller and gives and indication of the force required to rupture the coating. The higher the number, the better the result. Slope is the rate of ink tack build as the ink roller is passed over the paper board sample numerous times. The optimium rate of ink tack build for offset printing is in the range of 6-10.

Cast Coating Composition

Table 4 shows typical cast coating formulations using the amphoteric co-binder as a replacement for casein (milk protein).

TABLE 4

Cast coating composition having a solids concentration of 30% is formulated as below.

| Ingredient | Weight in parts per hundred pigment (php) |
|---|---|
| Clay | 80-100 |
| Satin white | 0-20 |

TABLE 4-continued

Cast coating composition having a solids concentration of 30% is formulated as below.

| Ingredient | Weight in parts per hundred pigment (php) |
|---|---|
| Styrene-butadiene latex or polyvinylacetate latex | 15 |
| Calcium stearate (release agent) | 5 |
| Amphoteric co-binder | 1-5 |
| Wt. % solids | 30% |
| Coat weight | 15 g/m$^2$ |

The cast coating composition above is coated onto a paper substrate by means of a comma coater in a properly varied amount, pressed against a cast drum heated to 100° C. while the coating composition on the substrate is in a wet condition, and thereby dries.

We claim:

1. A paper or paperboard coating composition comprising (a) a substantially water-soluble amphoteric synthetic (co) polymeric co-binder, having an overall anionic charge, and a weight average molecular weight of about 40,000 to about 2,000,000 Daltons, (b) a pigment, wherein the pigment makes up about 50 to about 90 percent by weight of the total solids weight of the coating composition, (c) a primary binder, wherein the primary binder is selected from the group consisting of latex polymers, styrene butadiene, styrene acrylate lattices, starch or modified starch, polyvinyl acetate, hydrolyzed polyvinyl acetate, polyvinyl acetate-acrylate, ethylene vinyl acetate, polyvinyl alcohol and mixtures thereof and optionally, (d) other coating additives, wherein the (co)polymeric co-binder is formed from ethylenically unsaturated, monomer(s) or macromer(s) selected from the group consisting of i) cationic and anionic or potentially anionic monomer(s) or macromer(s) and optionally nonionic monomer(s) or macromer(s);

and iii) zwitterionic or potentially zwitterionic monomer(s) or macromer(s) and anionic or potentially anionic monomer(s) or macromer(s) and optionally nonionic monomer(s) or macromer(s);

wherein i,) or iii.) may optionally further comprise a crosslinking agent, wherein the cationic monomer(s) are selected from the group consisting of dialkylaminoalkyl(meth)acrylates quaternary salts, dialkylaminoalkyl(meth)acrylamides quaternary salts, N,N-diallyldialkyl ammonium halides, acid addition salts or quaternary ammonium salts of allyl amines, acid addition salts or quaternary ammonium salts of diallyl amines and cationic vinylpyridines.

2. The composition as defined in claim 1 wherein the pigment is near white pigment, white pigment or mixtures thereof.

3. The composition as defined in claim 2 wherein the near white pigment or white pigment is selected from the group consisting of kaolin, calcium carbonate, precipitated calcium carbonate, calcined kaolin, titanium dioxide, aluminum trihydrate, talc, calcium sulfate, precipitated silica, calcined clay, zeolites, synthetic polymeric pigments and mixtures thereof.

4. The composition as defined in claim 1 wherein the composition is a cast coatings composition.

5. The composition according to claim 1 wherein the (co) polymeric co-binder has a molar ratio of anionic charge to cationic charge of about greater than 1 to about 5, the ratio being defined as the moles of anionic monomer(s) divided by the moles of cationic monomer(s) used to form the (co)polymeric co-binder.

6. The composition according to claim 5, wherein the molar ratio is about 1.1 to about 4.

7. The composition according to claim 1, wherein the coating additives are selected from the group consisting of lubricants, stabilizers, dispersants, defoamers, biocides, preservatives and mixtures thereof.

8. The composition according to claim 1, wherein the crosslinking agent is a molecule having at least difunctionality.

9. The composition according to claim 8, wherein the crosslinking agent is selected from the group consisting of N,N'-methylenebisacrylamide, trimethylolpropane tri (meth)acrylate, glycerol tri(meth)acrylatemethylol acrylamide, N,N'-methylenebismethacrylamide, polyethyleneglycol diacrylate, polyethyleneglycol dimethacrylate, N-vinylacrylamide, divinylbenzene, acrolein, glyoxal, diepoxy compounds, epichlorohydrin, tetraallylammonium chloride, glycidyl(meth)acrylate and allyl glycidylether.

10. The composition according to claim 1 wherein the nonionic monomer(s) or macromer(s) are selected from the group consisting of acrylamide, methacrylamide, N-methyl(meth)acrylamide, N,N-dimethyl(meth)acrylamide, N-isopropyl(meth) acrylamide, N-(2-hydroxypropyl)(meth)acrylamide, N-methylolacrylamide, N-vinylformamide, N-vinylacetamide, N-vinyl-N-methylacetamide, fumaramide, N-vinyl-2-pyrrolidone, glycerol mono((meth)acrylate), poly(ethylene glycol)(meth)acrylate, poly(ethylene glycol) monomethyl ether mono(meth)acrylate, 2-hydroxyethyl(meth)acrylate, vinyl methylsulfone, vinyl acetate, diacetone acrylamide, diesters of maleic, fumaric, succinic, itaconic acids, methyl(meth)acrylate, ethyl(meth)acrylate, hexyl(meth)acrylate, octyl(meth) acrylate, stearyl(meth)acrylate, stearyl ethoxy(meth) acrylate, stearyl ethoxyallylether and mixtures thereof.

11. The composition according to claim 10 wherein the nonionic monomer(s) is selected from the group consisting of acrylamide, methacrylamide, methylmethacrylate hydroxyethylmethacrylate and mixtures thereof.

12. The composition according to claim 11 wherein the nonionic monomer(s) is acrylamide.

13. The composition according to claim 1 wherein the cationic monomer(s) or macromer(s) are selected from the group consisting of N,N-dimethylaminoethylacrylate methyl chloride quaternary salt and diallyldimethylammonium chloride.

14. The composition according to claim 1 wherein the anionic or potentially anionic monomer(s) or macromer(s) are derived from alpha ethylenically unsaturated monomers selected from the group consisting of alpha ethylenically unsaturated monomers containing phosphate or phosphonate groups, alpha ethylenically unsaturated monocarboxylic acids, monoalkylesters of alpha ethylenically unsaturated dicarboxylic acids, monoalkylamides of alpha ethylenically unsaturated dicarboxylic acids, alpha ethylenically unsaturated compounds comprising a sulphonic acid group, salts of alpha ethylenically unsaturated compounds comprising a sulphonic acid group, hydrolyzed acrylamide, hydrolyzed (meth)acrylate esters and mixtures thereof.

15. A composition according to claim 14 wherein the anionic or potentially anionic monomer(s) or macromer(s) are selected from the group consisting of acrylic acid, methacrylic acid, vinyl sulphonic acid, salts of vinyl sulfonic acid, vinylbenzene sulphonic acid, salts of vinylbenzene sulphonic acid, alpha-acrylamidomethylpropanesulphonic acid, salts of alpha-acrylamidomethylpropanesulphonic acid, 2-sulphoethyl methacrylate, salts of 2-sulphoethyl methacrylate, acrylamido-2-methylpropanesulphonic acid (AMPS), salts of acrylamido-2-methylpropanesulphonic acid, maleic acid, fumaric acid, itaconic acid, succinic acid, styrenesulphonate, hydrolyzed acrylamide, hydrolyzed (meth)acrylate esters, salts thereof and mixtures thereof.

16. The composition according to claim 1 wherein the percent weight of the nonionic monomer(s) or macromer(s) is about 20 to about 99, wherein the weight is based on the total weight of the (co)polymeric co-binder.

17. The composition according to claim 1, wherein the cationic monomer(s) or macromer(s) are selected from the group consisting of dimethylaminoethyl acrylate methyl chloride quaternary salt, dimethylaminoethyl acrylate methyl sulfate quaternary salt, dimethylaminoethyl acrylate benzyl chloride quaternary salt, dimethylaminoethyl methacrylate methyl chloride quaternary salt, dimethylaminoethyl methacrylate methyl sulfate quaternary salt, dimethylaminoethyl methacrylate benzyl chloride quaternary salt, diethylaminoethyl acrylate methyl chloride quaternary salt, diethylaminoethyl methacrylate methyl chloride quaternary salt, methacrylamidopropyltrimethylammonium chloride, acrylamidopropyltrimethylammonium chloride, dimethylaminopropylacrylamide methyl sulfate quaternary salt, diallyldiethylammonium chloride, diallyldimethyl ammonium chloride, acid addition salts of diallylamine, and cationic vinylpyridine.

18. The composition according to claim 1, wherein the (co)polymeric co-binder has a molecular weight of about 40,000 to about 500,000 Daltons.

19. The composition according to claim 18, wherein the (co)polymeric co-binder has a molecular weight of about 80,000 to about 250,000 Daltons.

20. The composition according to claim 1, wherein the (co)polymeric co-binder makes up about 0.1 to 15 parts weight per hundred parts weight of pigment.

21. The composition according to claim 20, wherein the (co)polymeric co-binder makes up about 0.5 to 6 parts weight per hundred parts weight of pigment.

22. A composition according to claim 1, wherein the zwitterionic monomer(s) or macromer(s)

are selected from the group consisting of N,N-dimethyl-N-acryloyloxyethyl-N-(3-sulfopropyl)-ammonium betaine, N,N-dimethyl-N-acryloyloxyethyl-N-(2-carboxymethyl)-ammonium betaine, N,N-dimethyl-N-acrylamidopropyl-N-(3-sulfopropyl)-ammonium betaine, N,N-dimethyl-N-acrylamidopropyl-N-(2-carboxymethyl)-ammonium betaine, 2-(methylthio)ethyl methacryloyl-S-(sulfopropyl)-sulfonium betaine 2-[(2-acryloylethyl)dimethylammonio]ethyl 2-methyl phosphate, 2-(acryloyloxyethyl)-2'(trimethylammonium)ethyl phosphate,

[(2-acryloxyethyl)dimethylammonio]methyl phosphonic acid, 2-methacryloyloxyethyl phosphorylcholine (MPC), 2-[(3-acrylamidopropyl)dimethylammonio]ethyl 2'-isopropyl phosphate (AAPI), 1-vinyl-3-(3-sulfopropyl)imidazolium hydroxide, (2-acryloxyethyl)carboxymethyl methylsulfonium chloride, 1-(3-sulfopropyl)-2-vinylpyridinium betaine, N-(4-sulfobutyl)-N-methyl-N,N-diallylamine ammonium betaine (MDABS), N,N-diallyl-N-methyl-N-(2-sulfoethyl)ammonium betaine and mixtures thereof.

23. A paper or paperboard coating composition according to claim 1, wherein the primary binder is selected from the group consisting of latex polymers, styrene butadiene, styrene acrylate lattices, polyvinyl acetate, hydrolyzed polyvinyl acetate, polyvinyl acetate-acrylate, ethylene vinyl acetate, polyvinyl alcohol and mixtures thereof.

24. A paper or paperboard coating composition according to claim 1, wherein the primary binder makes up about 10 to about 40 wt. % of the total solid pigments in the composition.

25. A paper or paperboard coating composition according to claim 1, wherein the primary binder makes up about 10 to about 40 wt. % of the total solid pigments in the composition and the (co)polymeric co-binder makes up about 0.1 to 15 parts weight per hundred parts weight of pigment.

26. A method of improving glueability and coating structure of a paper or paperboard coating by incorporating a composition according to claim 1 onto the surface of a paper or paperboard.

* * * * *